US006585549B1

(12) United States Patent
Fryar

(10) Patent No.: US 6,585,549 B1
(45) Date of Patent: Jul. 1, 2003

(54) MOMENTUM INDUCED WAKEBOARD STABILIZATION SYSTEM

(76) Inventor: Jared Fryar, 1449 Lindberg Ave., Alamogordo, NM (US) 88310

( * ) Notice: Subject to any disclaimer, the term of this patent is extended or adjusted under 35 U.S.C. 154(b) by 0 days.

(21) Appl. No.: 10/115,351

(22) Filed: Apr. 2, 2002

(51) Int. Cl.[7] ..... B63B 35/79

(52) U.S. Cl. ..... 441/79; 441/65; 441/74

(58) Field of Search ..... 441/65, 68, 74, 441/79

(56) References Cited

U.S. PATENT DOCUMENTS 5,152,705 A * 10/1992 Rock ..... 441/74
6,149,479 A * 11/2000 Redmon et al. ..... 441/79

* cited by examiner

*Primary Examiner*—Sherman Basinger

(57) ABSTRACT

A wakeboard 10 having rear, rear quarter, front quarter, and front vane pairs that channel water towards the longitudinal axis of the wakeboard 10 to provide directional stabilization for the wakeboard. The longitudinally symmetric location of the vane pairs enhances rider control and performance of the wakeboard during maneuvers without the use of fins or hydrofoils.

5 Claims, 5 Drawing Sheets

MOMENTUM INDUCED WAKEBOARD STABILIZATION SYSTEM

BACKGROUND

1. Field of Invention

This invention relates to watercraft towed floatation devices such as wakeboards or a kneeboards.

2. Description of Prior Art

It is well known that hydrofoils such as fins, which are attached to wakeboards or other hulled craft, can be used to provide a desired reaction force when in motion relative to the fluid through which the hydrofoil is passing. As used hereinafter the term "wakeboard" shall include wakeboards, kneeboards, and other hulled craft, which are towed by the watercraft relative to the craft's center of gravity. Hydrofoils are commonly used for directional stability, and typically and currently, extend downwardly a distance and generally perpendicularly, i.e. 90 degrees from the plane of the bottom wakeboard surface. With the advancement of wakeboarding type sports wakeboards are currently being used to jump from water-ski jumps or used to slide across rails which are raised above the surface of the water. As a wakeboard and rider is towed over a ski jump or rail the weight of the wakeboard and rider may be born by the perpendicularly mounted fins on the bottom surface of the wakeboard. The typical shape of the fin does not allow for the fin to withstand such forces and the fin can break, separate from the wakeboard, or be severely damaged. This invention provides a directional stabilization system, which can structurally withstand the excessive forces created when a wakeboard is used on a ski-jump or rail.

A fin stabilized wakeboard typically and currently, has a front and rear longitudinal center fin which allows for the board to be easily ridden either forward or backwards. The problem with the front and rear mounted fins is when the wakeboard is pivoted on the surface of the water to bring the rear of the wakeboard forward, the flow of water impinges on the large side surfaces of the fins creating drag and increasing the difficulty for the rider to rotate the board. This invention provides for a finless directional stabilization system that allows for easy rotation of the wakeboard on the surface of the water, and allows for the wakeboard to be easily ridden forward or backwards.

It is well known that stable "finless wakeboards" have been attempted previously without real success. A typical "finless wakeboard" consists of longitudinally extended fins that are incorporated into the structure of the wakeboard, and or channels that run longitudinally along the wakeboard. The extended fins operate in the same manner as shorter fins in that they create pressure differences in the water as it flows over the fin at different angles of attack. The problem with the longitudinal channels is that they do not channel enough water to create the magnitude of stabilizing forces necessary to provide a directionally stable platform for the rider to stand or kneel on. This invention provides a change in momentum based stabilization system that truly solves the "finless wakeboard" dilemma.

OBJECTS AND ADVANTAGES

Accordingly several objects and advantages of my invention are a finless directional stabilization system that allows a wakeboard to be easily towed sideways, or to easily change orientation of the wakeboard (spin the wakeboard end for end), provide a stabilization system that is structurally strong enough to support the downward forces created when the wakeboard and rider are towed over a ski jump or rail, provide one method to successfully directionally stabilize a wakeboard without the use of hydrofoils or fins.

Other objects and advantages are that by channeling water near the side edge of the wakeboard and using the momentum of the channeled water during a turn enhances the rider's control and hold while increasing the speed of the wakeboard around the turn. When a wakeboard is angled over on its edge in a turn, the speed of the wakeboard around the turn is dependent on the amount of water channeled by the side edge of the wakeboard. Locating the vanes used to channel the water near the right and left sides of the wakeboard allows for a larger, predetermined amount of water to be channeled during turns. By increasing the amount of water channeled during a turn the rider is able to turn faster towards the wake and jump higher off of the wake.

Further objects and advantages of my invention will become apparent from a consideration of the drawings and ensuing description.

DRAWING FIGURES

In the drawings, closely related figures have the same number but different alphabetic suffixes.

Figure 1:
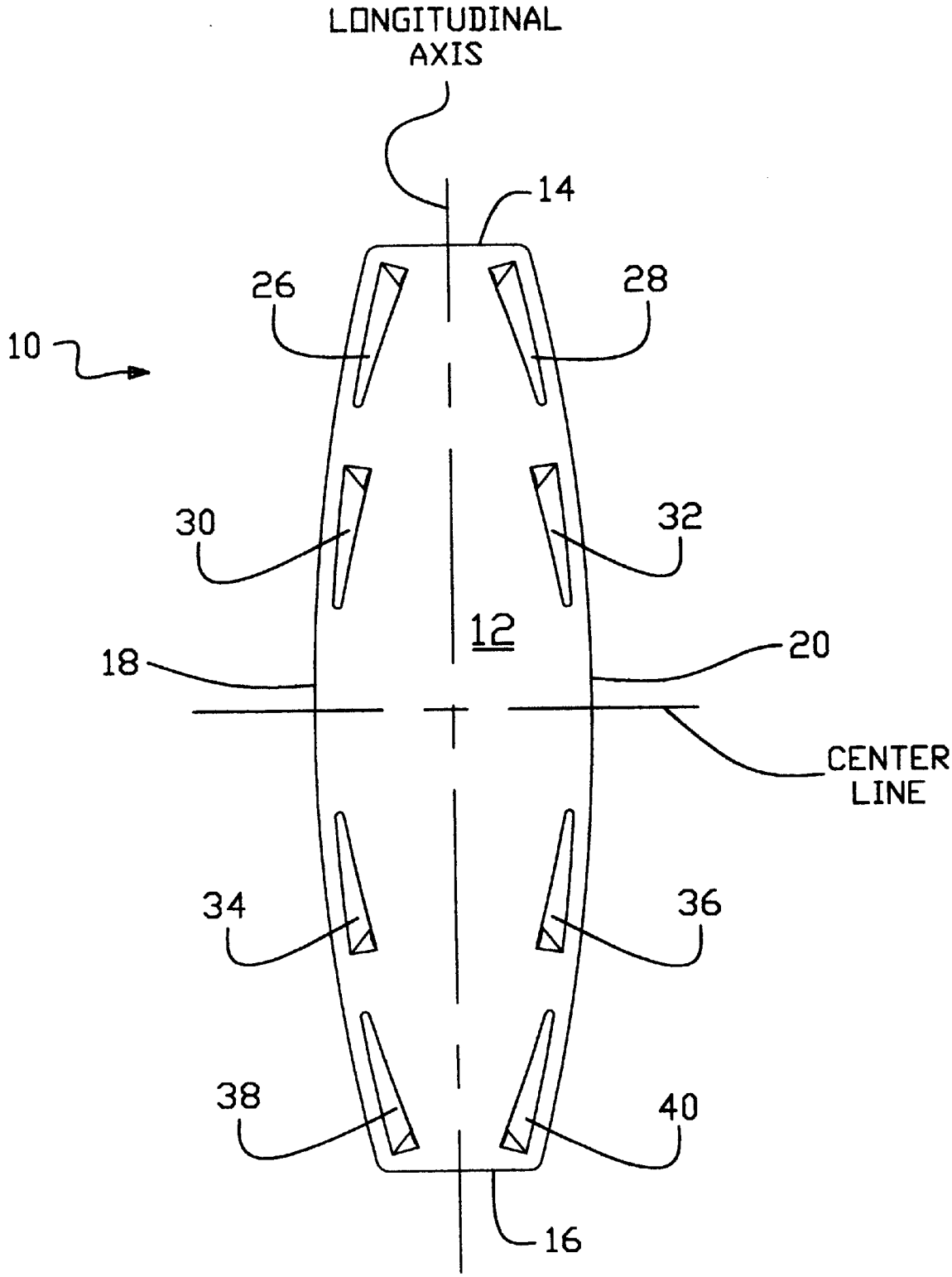
FIG. 1 is a bottom plan view of the wakeboard of the invention with the momentum induced stabilization vanes.

| Reference Numerals In Drawings | |
|---|---|
| 10 wakeboard | 12 bottom surface |
| 14 front edge | 16 rear edge |
| 18 left side edge | 20 right side edge |
| 26 left front vane | 28 right front vane |
| 30 left front quarter vane | 32 right front quarter vane |
| 34 left rear quarter vane | 36 right rear quarter vane |
| 38 left rear vane | 40 right rear vane |
| 42 interior vane surface | 44 exterior vane surface |
| 46 leading edge | 48 trailing surface |

SUMMARY

In accordance with the present invention a wakeboard comprising a generally planar bottom having front, front quarter, rear quarter, and rear vane pairs extending downwardly.

Description—FIGS. 1–6

Figure 2:
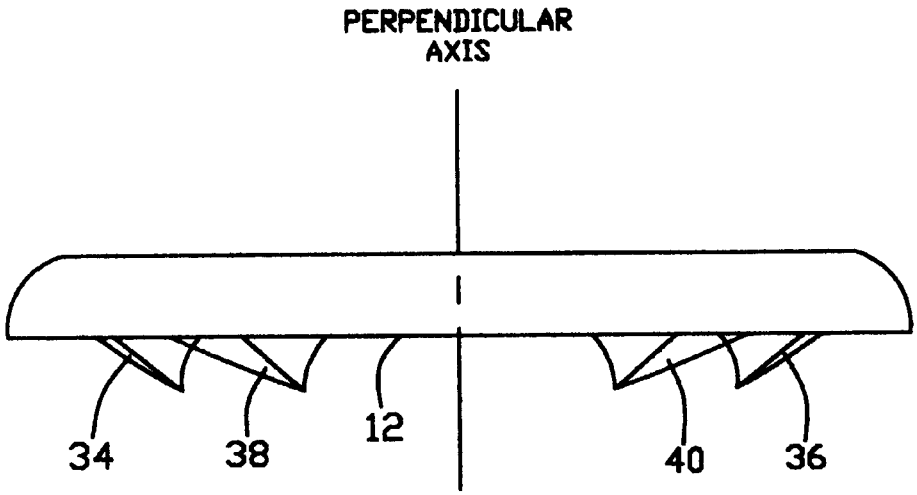
FIG. 2 is a plan, rear view of the wakeboard of FIG. 1.

A typical embodiment of a wakeboard 10 is illustrated in FIG. 1 and FIG. 2 with a planar bottom surface 12 having a left front vane 26, a right front vane 28, a left front quarter vane 30, a right front quarter vane 32, a left rear quarter vane 34, a right rear quarter vane 36, a left rear vane 38, and a right rear vane 40. All vanes 26,28,30,32,34,36,38,40 have the same elongated 3-sided pyramid shape. Four pairs of vanes protrudes from the planar bottom surface 12 of wakeboard 10. Each pair of vanes consists of a right vane and a left that is an exact mirror or the right vane. The front vane pair, vane 26 and 28, are positioned with the trailing surfaces 48 about 1" from a front edge 14 (e.g. ¼' to 2") and the outside vane surface of the right front vane 28 about 1" (e.g.¼" to 2") from a right side edge 20 and the exterior vane surface of the left front vane 26 about 1" (e.g.¼" to 2") from a left side edge 18. The front quarter vane pair, vane 30 and 32 are located between the front vane pair, vane 26 and 28, and a center line of the wakeboard 10. The right front quarter vane 32 outside surface is located about 1" (e.g.¼" to 2") from the right side edge 20 and the left front quarter vane 30 outside surface is located about 1" (e.g.¼" to 2") from the left side edge 18. The rear vane pair, vanes 38 and 40, are positioned with the trailing surfaces 48 about 1" from a rear edge 16 (e.g.¼' to 2") and the exterior vane surface of the right rear vane 40 about 1" (e.g.¼" to 2") from the right side edge 20 and the exterior vane surface of a left rear vane 38 about 1" (e.g.¼" to 2") from the left side edge 18. The rear quarter vane pair, vanes 34 and 36, are located between the rear vane pair, vane 38 and 40, and a center line of the wakeboard 10. The right rear quarter vane 36 exterior surface is located about 1" (e.g.¼" to 2") from the right side edge 20 and the left front quarter vane 34 exterior vane surface is located about 1" (e.g.¼" to 2") from the left side edge 18.

FIG. 2 is a plan, rear end view of the wakeboard of FIG. 1, which illustrates the three sided cross sectional shape and the perpendicular portion of the rear vane pair, vanes 38 and 40, and rear quarter vane pair, vanes 34 and 36, from the bottom surface 12 of the wakeboard 10.

Figure 3:
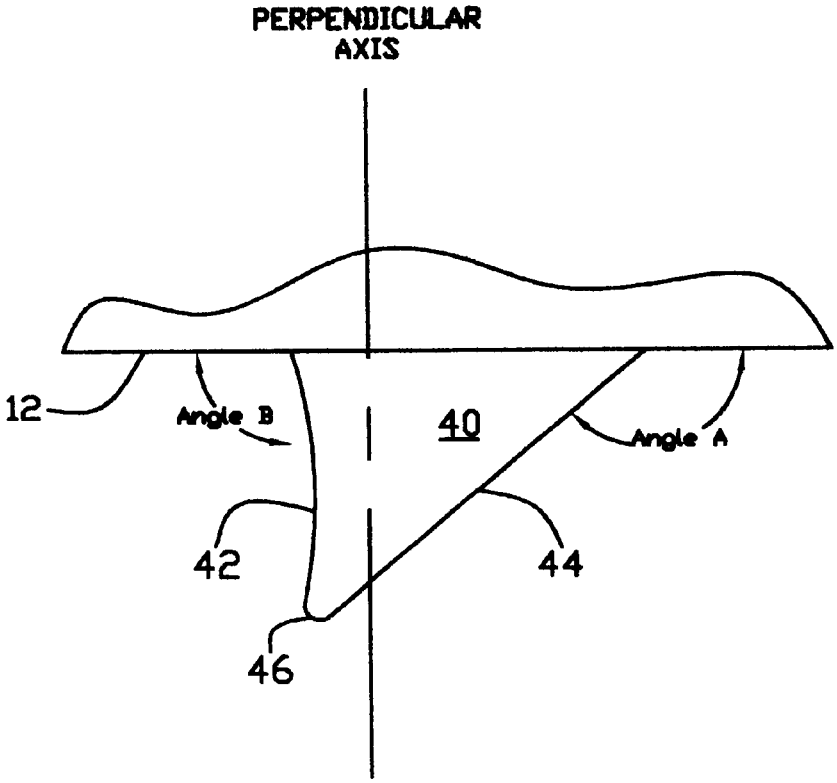
FIG. 3 is an enlarged schematic view of the right rear vane of FIG. 2.

FIG. 3 shows the right rear vane's 40 interior vane surface 42 that is generally concave or a flat planar surface, a leading edge 46, and wider, generally flat-planar exterior vane surface 44. In one embodiment the rear right vane 40, like the rear left vane 38, has a base thickness of about 1.5" (e.g. 1.25 to 2.75"); a depth of 1.25" (e.g.0.75" to 3.0"), the leading edge thickness of about ¼" (e.g. about ⅛" to ½"). Angle A is the exterior vane surface angle between the generally planar bottom surface 12 and the exterior vane surface 44 of about 140 degrees (e.g. 130 degrees to 150 degrees). Angle B is the interior vane surface angle between the generally planar bottom surface 12, and a flat planar interior vane surface 42 of about 90 degrees (e.g. about 80 degrees to 100 degrees). If the interior vane surface 42 is concave angle B is generally 90 degrees.

Figure 4:
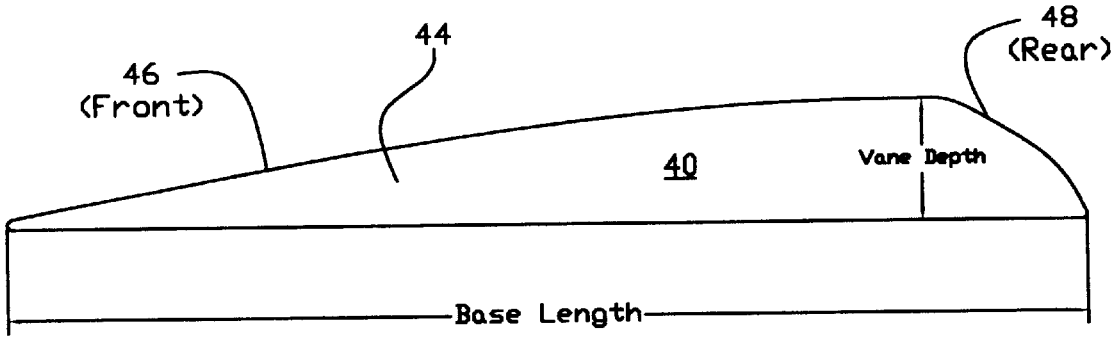
FIG. 4 is an enlarged side view of the exterior vane surface of the vane of FIG. 2.

FIG. 4 is a side plan view of the rear right vane 40 showing the rear side fin dimensions and position, with the leading edge 46 of vane 40 tapered to a rounded edge toward the front of the wakeboard in its forward movement, and an arcuate curved or flat planar trailing surface 48. The vane depth is at its greatest depth toward the last 15 to 25 percent of the vane base length.

Figure 5:
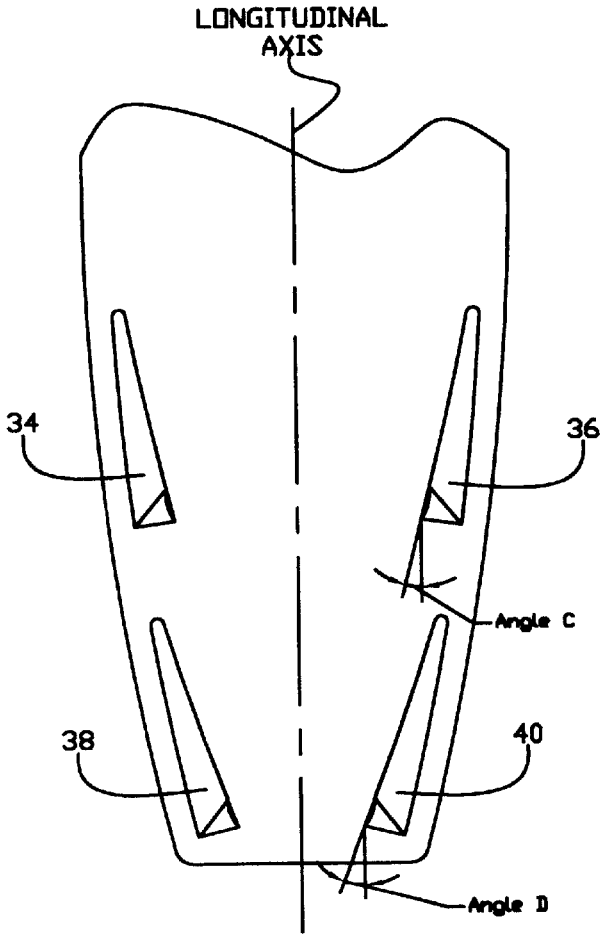
FIG. 5 is a schematic view of the rear vane pair and rear quarter vane pair of FIG. 1.

FIG. 5 is a schematic plan view of the rear quarter vane pair, vanes 34 and 36, and the rear vane pair, vanes 38 and 40, with the interior vane surface of the rear quarter vanes at an angle C of generally 16 degrees (e.g. 10 degrees to 25 degrees) with the longitudinal axis and the interior vane surface of the rear vane pair, vanes 38 and 40, at an angle D of generally 23 degrees (e.g. 10 degrees to 40 degrees) with the longitudinal axis.

Figure 6:
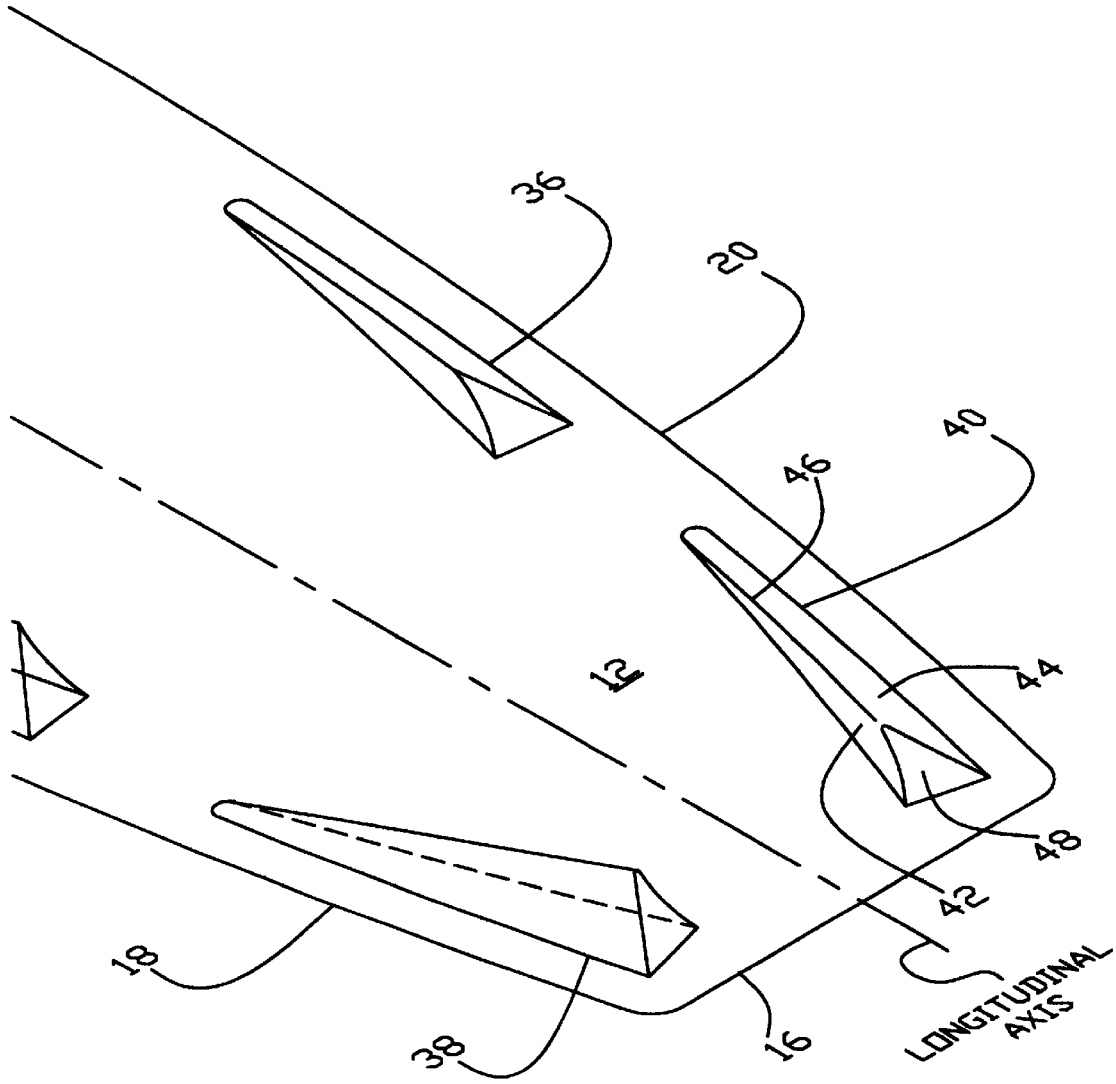
FIG. 6 is a schematic, perspective view of the right rear vane of FIG. 1.

FIG. 6 is a perspective plan view of the right rear vane 44.

Operation—FIG. 7

Figure 7A:
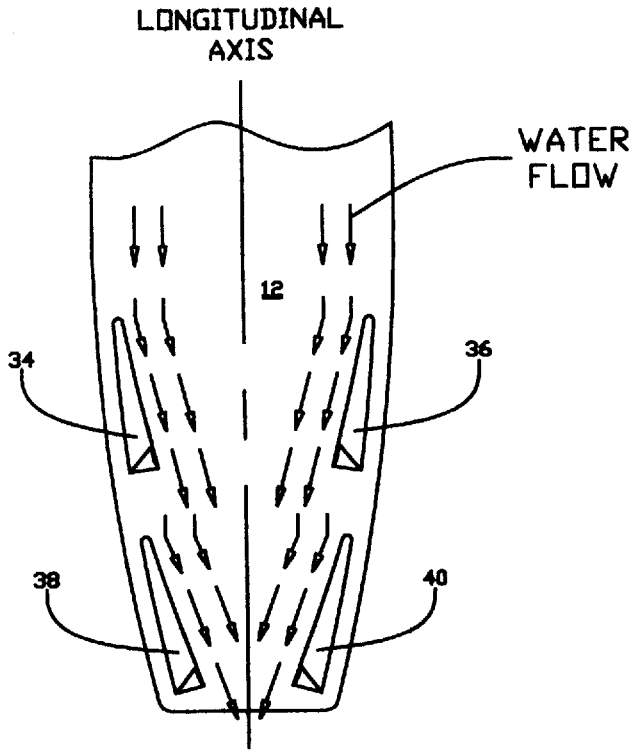
FIGS. 7A and 7B are schematic, plan rear end views of the wakeboard of FIG. 1 showing the water flow to illustrate the directional stabilization effects when the flow of water is parallel to the longitudinal axis in FIG. 7A and when the flow of water is at an angle to the longitudinal axis in FIG. 7B.

FIG. 7A shows the flow of water over the generally planar bottom surface 12 in line with the longitudinal axis of the wakeboard 10. As the diagram shows, the water flowing over the interior vane surfaces 42 of the vanes is channeled towards the longitudinal axis of the wakeboard. Due to the longitudinal axis symmetry of the rear vane pair, vanes 38 and 40, and the rear quarter vane pair, vanes 34 and 36, there is no net reaction force of the channeled water.

Figure 7B:
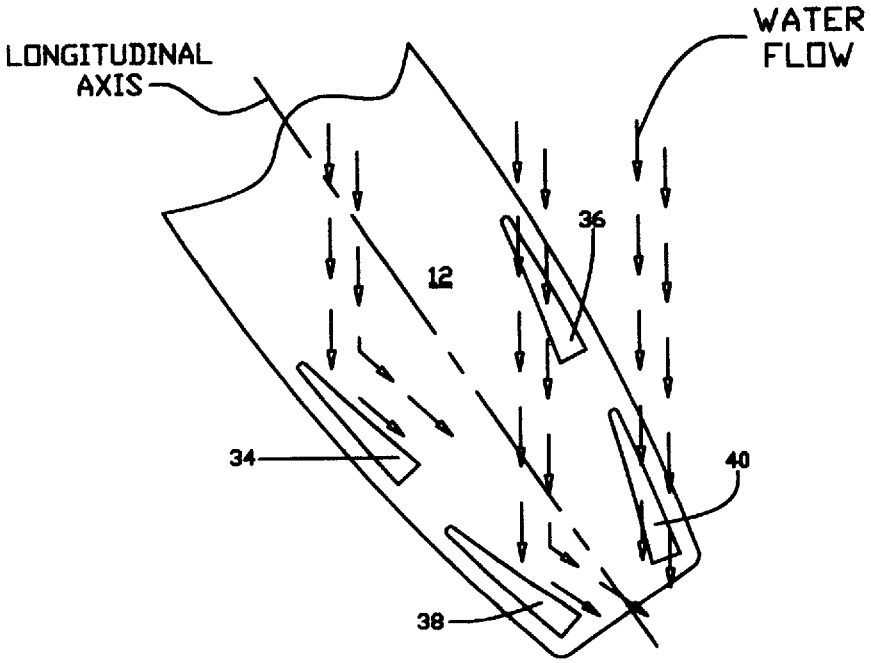

FIG. 7B shows the flow of water over the bottom surface 12 at an angle to the wakeboard longitudinal axis. As the diagram shows, the flow of water is allowed to flow over the exterior vane surfaces 44 of the left vanes, vanes 34 and 38, while the water is channeled towards the wakeboard longitudinal axis by the interior vane surfaces 42 of the right vanes, vanes 36 and 40. The change in momentum of the water being channeled by the interior vane surfaces 42 of the right vanes creates a net force towards the right that pivots the wakeboard 10 until the flow of water is in line with the wakeboard longitudinal axis.

FIG. 7B also illustrates the channeling of water by the vanes when the wakeboard 10 is laid over on its left side edge 18. The interior vane surfaces 42 of vanes 36 and 40 channel water in addition to the water channeled by the left side edge 18 of the wakeboard 10. The change in momentum of the channeled water by vanes 36 and 40 create forces that increase the speed of the wakeboard 10 during a turn. During a right side edge 20 turn the left side edge 18 and vanes 34, 38, 26, 28, 30, 32 are lifted out of the water and have no effect on the wakeboard performance.

FIG. 1 shows the location and size of the vanes 26,28, 30,32,34,36,38,40 on the bottom surface 12 of the wakeboard 10. The size and location of the vanes enables them to support the weight of the wakeboard 10 and rider without damaging the vanes or the wakeboard 10.

Conclusion, Ramifications, and Scope

Thus the reader will see that the wakeboard of the invention provides an innovative method to directionally stabilize a watercraft towed floatation device without the use of typical hydrofoils or fins.

While my above description contains many specifics, these should not be construed as limitations on the scope of the invention, but rather as an exemplification of one preferred embodiment thereof Many other variations are possible:

- A watercraft-towed flotation device that is ridden with a definite front and rear does not need all eight vanes. Only the two rear quarter vanes and two rear vanes are necessary.
- The two front quarter vanes and two rear quarter vanes may be proportionally smaller than the two front and two rear vanes to allow for a sloped or curved bottom surface of the wakeboard.
- Two rear quarter vanes and two rear vanes or all eight vanes may be used to directionally stabilize a non-motorcraft towed floatation devise such as a surfboard of windsurfboard.
- A front and or rear centrally aligned, longitudinal axis symmetrical fin may be added in addition to the vanes for added directional stabilization.
- The vane pairs may be made integrally with the wakeboard or separately and attached to the bottom surface of a wakeboard.

Accordingly, the scope of the invention should be determined not by the embodiments illustrated, but by the appended claims and their legal equivalents.

I claim:

1. A wakeboard for use behind a watercraft, which wakeboard comprises:

a. A longitudinal axis and a perpendicular axis; a generally planar bottom surface; a front, rear, left side, and right side edge; and a front and rear end; and b. At least two pairs of vanes, one rear pair of vanes and one rear quarter pair of vanes, each vane having a generally planar or concave interior vane surface, a generally planar exterior vane surface, and an arcuate curved or planar trailing surface, wherein the vanes are characterized by an elongated pyramid shape where said interior surface and said exterior surface meet to create a leading edge, and said interior surface and said exterior surface meet said trailing surface, and extends downwardly from said generally planar bottom surface; and c. the rear vane pair at the rear end, front end, or both ends of the wakeboard are spaced apart and positioned with the exterior vane surface of a left rear vane near and along the left side edge and the exterior vane surface of a right rear vane near and along the right side edge, the trailing surfaces of the rear vanes located near and along the rear edge; and d. the rear quarter vane pair located between the rear vane pair and a center line, or a front vane pair and the center line, or both are spaced apart and positioned with the exterior vane surface of a right quarter vane near and along the right side edge and a left quarter vane exterior vane surface near and along the left side edge on the planar bottom surface of said wakeboard.

2. The wakeboard of claim 1 wherein the vanes have a base length and a vane depth, and the vane depth is greatest toward the last 15 to 25 percent of the base length.

3. The wakeboard of claim 1 wherein the exterior vane surfaces of the vanes provide a means to allow water to flow over the vanes.

4. The wakeboard of claim 1 wherein the interior vane surfaces of the vanes provide a means to channel water towards a center longitudinal axis of the wakeboard thereby providing directional stability for said wakeboard.

5. The wakeboard of claim 1 wherein the interior vane surface, exterior vane surface and trailing surface of the vanes form an elongated pyramid shape capable of supporting the weight of said wakeboard and a rider.

* * * * *